United States Patent [19]

Morse

[11] Patent Number: 4,723,506

[45] Date of Patent: Feb. 9, 1988

[54] SHOE SUBSTRATE REINFORCING MACHINE

[75] Inventor: Albert I. Morse, Beverly, Mass.

[73] Assignee: DVSG Patentverwaltungs GmbH, Frankfurt, Fed. Rep. of Germany

[21] Appl. No.: 892,554

[22] Filed: Aug. 4, 1986

[51] Int. Cl.[4] ..... B05C 13/00

[52] U.S. Cl. ..... 118/503; 118/231

[58] Field of Search ..... 118/503, 231; 269/238

[56] References Cited

U.S. PATENT DOCUMENTS 4,502,411 3/1985 Gilbride et al. ..... 118/503

*Primary Examiner*—John P. McIntosh

[57] ABSTRACT

A machine is disclosed which deposits powder in a selected configuration, fuses the configured powder into a laminate and adheres the fused laminate to a shoe substrate. The machine has a two part clamp which is displaceable from a retracted position to a clamp position. The part that is to clamp the substrate is interconnected with the other part by pins which extend through slots in the clamping part. The slots are wider than the pins so that relative linear and swivel motion is possible between this part.

3 Claims, 2 Drawing Figures

SHOE SUBSTRATE REINFORCING MACHINE

Figure 1:
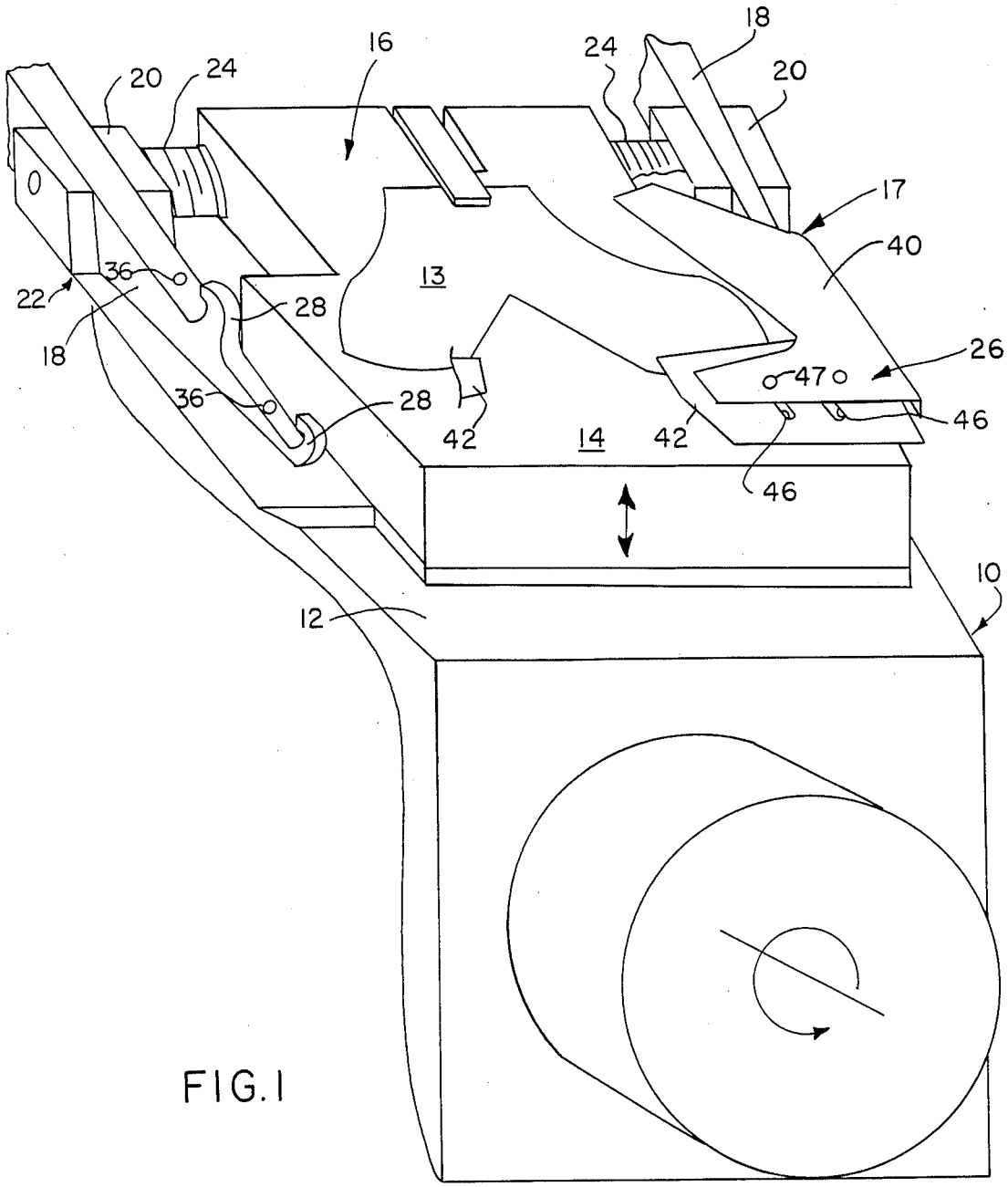

The present invention relates to machines which deposit powder in a selected configuration, fuse the powder into a laminate and adhere the fused laminate to a shoe substrate to reinforce the substrate, and more particularly, to substrate clamping mechanisms for such machines. When a shoe substrate such as a counter is to be clamped to the work support surface in these machines, a well defined but limited peripheral area is available for clamping purposes. Since counters for a particular shoe design vary in size with shoe size, the location of this available clamping area also changes with shoe size.

It is an object of the present invention to provide a clamping assembly that can effectively clamp any counter of a family within the limited peripheral area available on each counter.

Other objects and advantages of the present invention will become apparent from the following portion of this specification and from the accompanying drawings which in accordance with the mandate of the patent statutes, a presently preferred embodiment incorporating the principles of the invention.

Figure 2:
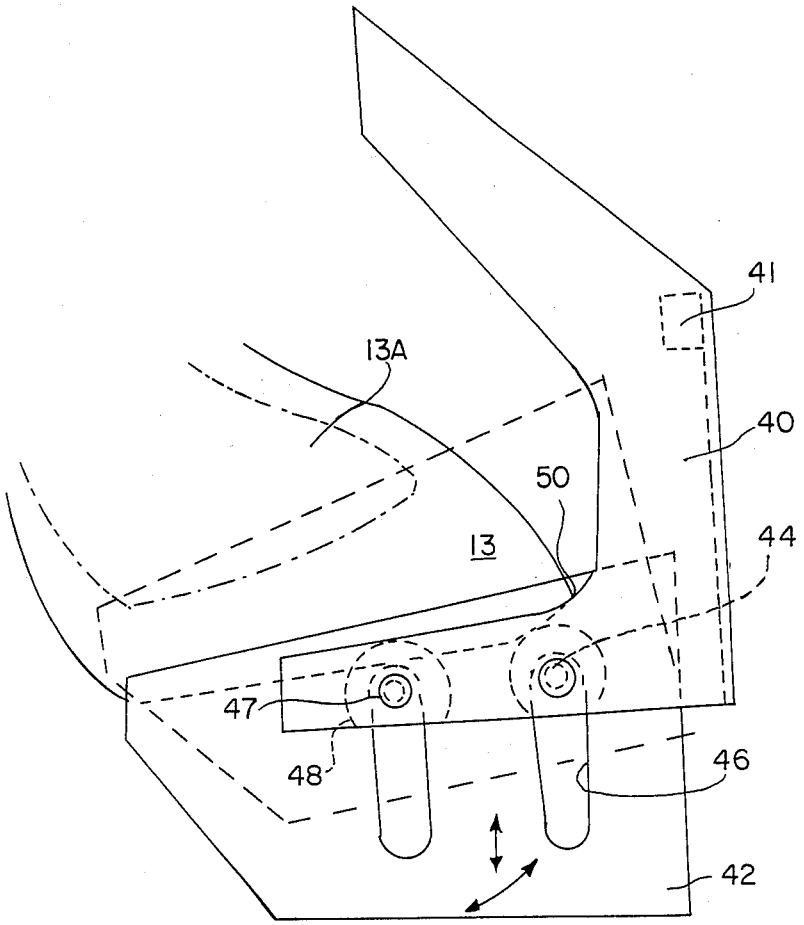

Referring to the drawings:

FIG. 1 is a top oblique view of a portion of the work transfer cube of a shoe substrate reinforcing machine which deposits powder in a selected configuration, fuses the configured powder into a laminate and adheres the fused laminate to a shoe substrate to reinforce the substrate. Only one of the faces is shown and one of the removable clamps has been removed for clarity; and FIG. 2 is a top view of the clamp shown in FIG. 1.

A shoe substrate reinforcing machine which deposits powder in a selected configuration, fuses the powder into a laminate and adheres the laminate to a shoe substrate to reinforce the shoe substrate utilizes a work transfer device (a cube 10 having four faces 12). The work transfer cube is mounted on a spindle (not shown) which is indexable around a horizontal axis to four 90° positions. The top or upper horizontal face 12 is the load/unload face where a shoe substrate 13 to be reinforced can be clamped in position on the support pad 14 of a mounting assembly 16 by clamping assemblies 17 located on either side of the mounting assembly 16. A clamped shoe substrate will be rotated 180° to a join and cool station where the transfer cube will be lowered into forceful engagement with a fused laminate to adhere the laminate to the shoe substrate. Complete details of the work transfer cube are illustrated in detail in U.S. Pat. No. 4,502,411.

Each clamping assembly 17 includes a lever arm 18 which is pivotally supported between a pair of posts 20 of a mounting bracket 22. The lever arm 18 is maintained in continuous cooperation with the mounting assembly 16 by a spring element 24 so that movement of the mounting assembly from a lowered position to an elevated position will pivot the lever arms 18 from an elevated release position to a lowered clamping position where the clamps 26 will clamp the substrate 13 against the support pad 14 of the mounting assembly 16.

The forward end of each lever arm 18 has a pair of "C" shaped pin receiving catches 28 which are adapted to matingly receive the pin (not shown) of a swivel bracket (not shown) to which a clamp 26 is secured. Detent mechanisms 36 releasably latch the pin (not shown) within a catch. Additional details of this structure are illustrated in U.S. patent application Ser. No. 851,841 which was filed on Apr. 14, 1986.

The clamp 26 illustrated in FIGS. 1 and 2 includes a first part 40 which moves with the lever arm 18. (The clamp may pivot about the axis of the pin and a counterweight 41 may be secured to the first clamp part 40 so that the front of the clamp assembly will be held up when the clamp is displaced to the elevated release position.) A second part 42 is keyed to the stationary part 40 via pin 44 and slot 46 connections. The pins 44 (the posts of rivets 47) have a diameter substantially less than the width of the slots so that in addition to vertical movement back and forth along the slots 46, the second clamp part 42 can be pivoted to a limited extent relative to the first part 40. The rivets 47 extend between the stationary part 40 and conical spring washers 48 which forcefully urges the two parts into mating engagement so that a setting for the second clamp part 42 will be maintained during repetitive clamp use. The length and width of the slots can be varied to achieve a greater displacement range. As can be seen from FIG. 2, a curved edge 50 of the first clamp part 40 which is proximate to the edge of the second part edge which engages the shoe substrate, overlies the second clamp part 42 throughout the displacement of the second part thereby tending to prevent the bending of the second clamp part 42.

A much smaller shoe substrate 13A is illustrated in dot dash lines to show how the moveable clamp part 42 can be displaced and reoriented to a new position (shown in broken lines) to effectively clamp the outer periphery of this shoe substrate.

What is claimed is:

1. A machine for depositing powder in a selected configuration, fusing the configured powder into a laminate and adhering the fused laminate to a shoe substrate comprising mounting plate means on which the shoe substrate is to be releasably clamped, clamp means associated with said mounting plate means adapted to be selectively moveable between a release position and a clamp position whereat a peripheral portion of the shoe substrate will be clamped to said mounting plate means including a first clamp part having a planar surface, a second planar clamp part having an edge portion for clamping the periphery of a supported shoe substrate, a pair of slots defined in said second part, a pair of pins secured at one end to said first part planar surface and extending through said slots, a washer secured to the other end of each of said pins for forcefully maintaining said second clamp part in frictional, mating engagement with said first clamp part, the width of said pins being selected to be less than the width of said slots so that said second part can be swivelled relative to said first part to reorient the clamping edge portion of said second part.

2. A machine according to claim 1 wherein said first clamp part planar portion includes a curved edge which overlies said second clamp part proximate said first clamp part edge.

3. A machine according to claim 1, wherein said slots are of equal length and parallel.

* * * * *